United States Patent [19]

Eriksson

[11] Patent Number: 4,577,577

[45] Date of Patent: Mar. 25, 1986

[54] SLIDING DOOR ARRANGEMENT

[75] Inventor: Runar Eriksson, Turku, Finland

[73] Assignee: Oy Wärtsilä AB, Helsinki, Finland

[21] Appl. No.: 610,642

[22] Filed: May 16, 1984

[30] Foreign Application Priority Data

May 27, 1983 [FI] Finland ..... 831912

[51] Int. Cl.[4] ..... B63B 19/00

[52] U.S. Cl. ..... 114/120; 49/360

[58] Field of Search ..... 49/360; 114/116, 117, 114/118, 119, 120, 173, 174, 175, 177, 335

[56] References Cited

U.S. PATENT DOCUMENTS 1,029,620 6/1912 Mazzolini ..... 114/120

FOREIGN PATENT DOCUMENTS 61946 6/1982 Sweden .

*Primary Examiner*—Sherman D. Basinger

*Attorney, Agent, or Firm*—John Smith-Hill

[57] ABSTRACT

A sliding door arrangement for closing a passage opening in a mainly vertical wall construction and comprising a mainly horizontally movable door unit, a door frame unit attachable to the wall construction, guide and closure devices of said door unit and sealing members of the door and the frame unit. The door unit is moved between two frame members of the frame unit. The door unit comprises a number of door members, of which at least one is movably adjusted in the direction of the passage walk. This movable adjustment allows a shift of the door member against the passage opening, during a final or an initial phase of the door unit motion parallel to the wall construction and guided by the guide devices. The door unit is brought by the shift into a tight contact against sealing members of the frame unit or is disconnected from a contact thereof.

20 Claims, 13 Drawing Figures

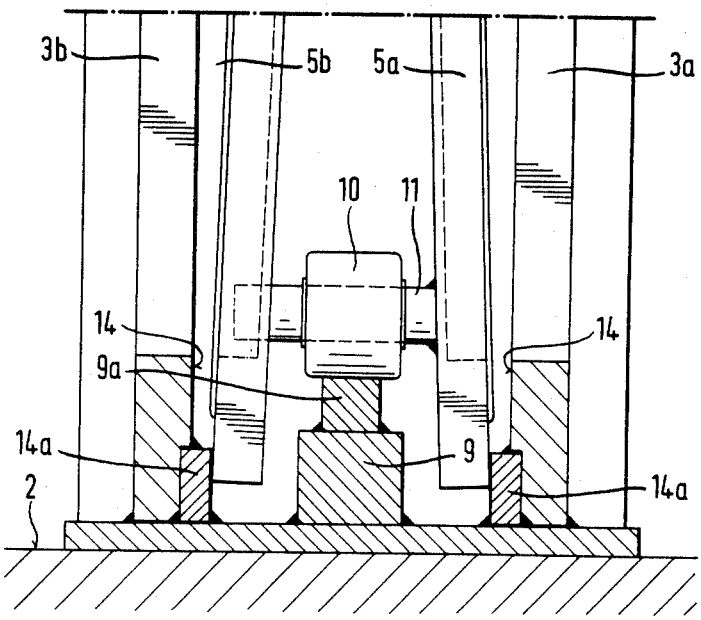
Fig. 9
Fig. 10
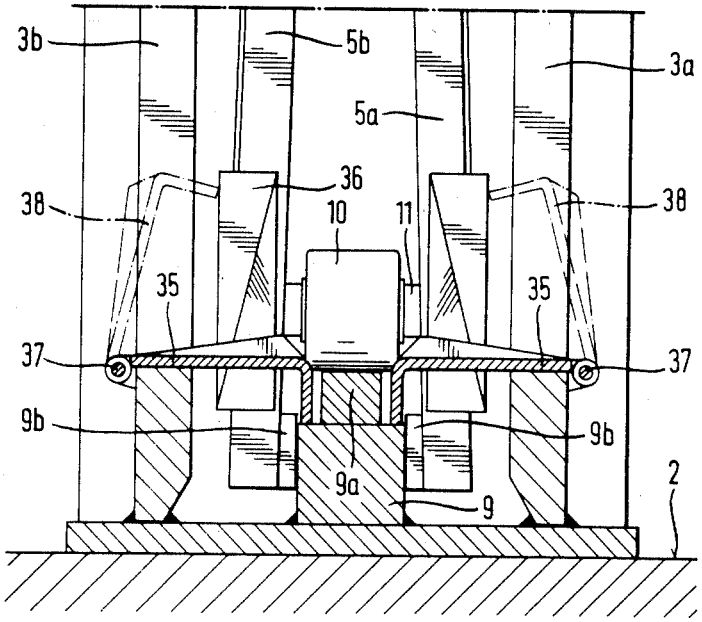

SLIDING DOOR ARRANGEMENT

FIELD OF THE INVENTION

The invention relates to a sliding door arrangement for closing a passage opening in a mainly vertical wall construction and comprising a mainly horizontally movable door unit, a door frame unit attachable to said wall construction, guide and closure devices of said door unit and sealing members of said door and said frame unit, said door unit being moved between two frame members of said frame unit.

BACKGROUND OF THE INVENTION

A water tight sliding door applied in ships requires a tight sealing contact between the door unit and the door frame, which surrounds the passage opening. The contact between the door unit and the frame must therefore be continuous all over the contact path. Sliding door arrangements of ships usually require high torsional and bending resistivity, as a result of which the frame and the door are usually rigid. Another alternative is known from the Finnish Patent publication 61946, in which the frame and the door unit are provided with flexible members, by which a continuous contact between the door unit and the frame is secured.

For a closure of the passage opening, the door unit is in both arrangements brought in contact by means of guiding wedge members, so that the door unit approaches the frame in a small approach angle. Hereby the door unit and the frame, or the sealing members thereof, are brought in a rubbing or sliding contact before the door unit motion stops. A similar rubbing contact appears during the initial opening phase of the passage, also. One drawback of the rubbing phenomenon is the wear of the sealing members. Furthermore, a portion of the driving power of the door unit motor is consumed only to overcome the rubbing friction.

OBJECT AND SUMMARY OF THE INVENTION

The object of the invention is to provide a water tight sliding door arrangement, in which a rubbing motion between corrresponding sealing surfaces is avoided. The object of the invention is possible by the arrangement defined in claim 1. A tight contact or the disconnection of the contact without rubbing is possible by shifting at least one movable member of the door unit in the passage opening direction, that is, against the plane determined by the frame. This shift is carried out during the final or the initial phase of the door unit motion, which for a closing or an opening action is directed along the wall.

A surprising extra advantage of the invention was discovered to be that the output power of the closure devices could be reduced. This is a consequence of the door unit governing principle according to the invention whereby no guide wedges are applied. The output power or work that is needed to compensate friction in an ordinary sliding door provided by guide wedges, is not necessary. In the arrangement according to the invention the required thrust power is considerably below half of the thrust power of an ordinary door arrangement which is of corresponding size.

In a favourable embodiment of the invention the shift against the opening and the door unit motion parallel to the wall are carried out at different times. The motion parallel to the wall is halted during the tight closure or the opening of the sealed passage opening. An embodiment that is favorable both functionally and from the point of view of manufacture is a separate module, inside which the door unit is moved. The frame unit and the door unit of the separate module are easily adjusted relative to each other and the module so assembled that the sliding door arrangement is, except for the final attachment to the wall construction, complete. The module is easily produced even far away from the actual working position, for instance outside the ship. The module can be mounted directly on a ship's deck or a like mainly horizontal supporting construction associated with the wall at the planned site of the passage. A favourable embodiment includes a self-supporting module, which can be directly connected to the wall and deck, for instance, by welding.

A construction which seals in both directions along the passage opening is possible by shiftable members, each of which is shifted in opposite directions by transmission members. These members can be parallel door plates, leaves or the like. In order to provide a desired function in a transmission member, closure devices and guard members of the door unit are acting on them. The guard members can be mechanically operated. An uncomplicated and secure shift is possible by a transfer member, which comprises a groove, an opening, a slot or the like in a door plate support member and a force or power transfer bar movable in the groove. The power transfer bar is acted upon by a closure member of the door unit, for instance by the transmission arm transmitting the power of the hydraulic cylinder. The co-operation between the arm, the transfer bar and the opening devices provides the necessary power for a door leaf shift. Another alternative transfer member comprises in a second door leaf a support member and a groove therein, a transfer element movable in this groove and connected to a slide, which moves parallel to the first door leaf. The slide is also connected via a bar to the door operating hydraulic cylinder. The shift magnitudes towards or away from the module main portion can be so arranged, that the second leaf motion is considerably larger than the motion of the first leaf.

The guide devices can comprise a guide rail and a thereon movable guide wheel, which is journalled at a support shaft. This arrangement makes possible a good directional guiding, at the same time holding the friction forces as low as possible. The support shaft is attached, in a favorable embodiment, at the first door plate and is movably supported at the second door plate, in order to facilitate their motions parallel to the travel direction through passage opening. The shaft is hereby arranged movable along the passage opening. In order to secure the closed position of the door unit, the guide rail can include a security member, for instance a depression in a separate guide lath, which is attached on the lowermost guide rail. The guide lath or its depression can be formed so as to be inclined slightly downwards relative to the upper surface of the guide rail. The inclination direction is so arranged, that the door unit motion is improved during the closure of the passage opening. The same security member is exploited during the opening of the sliding door, so that the door unit motion, which is parallel to the wall construction, is not started until the shift directed along the passage opening is compeleted.

BRIEF DESCRIPTION OF THE DRAWING

The invention is described with reference to the attached drawing in which

FIG. 9 shows a guide and support system of the sliding door according to the invention, FIG. 10 shows another application of the guide and support system.

AN EMBODIMENT OF THE INVENTION

Figure 1:
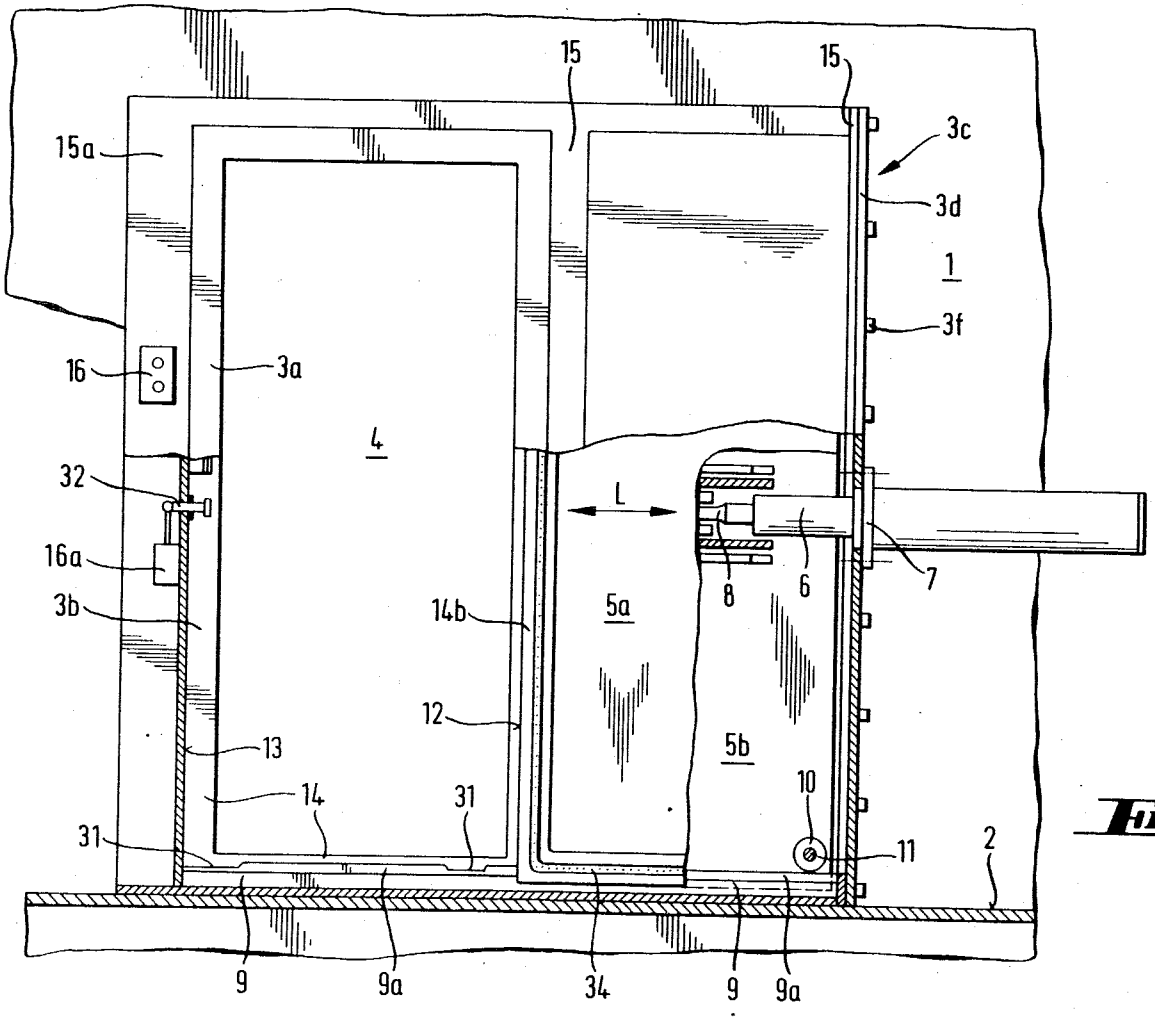
FIG. 1 discloses an embodiment of an opened sliding door according to the invention, viewed in the direction along the passage opening and partly sectioned.

In the drawing is shown a vertical bulkhead 1 and a horizontal bulkhead or a deck 2 of a ship, at which a sliding door module according to the invention is attached. For a secure and rigid attachment, the module is supported directly on deck 2. The self-supporting module can be attached to wall 1 and deck 2 without any auxiliary reinforcing members, for instance by welding. The door module comprises frame members 3*a* and 3*b* (FIG. 4), which include openings for the formation of a passage opening 4. The passage opening can be rectangular as shown or a circular opening, as well. Frame members 3*a*, 3*b* and an end plate 3*d* attached by bolts 3*f* to a casing head 3*c* form a casing inside which a door unit is moved in a direction L in order to close or to open passage opening 4. The door unit comprises two door plates 5*a*, 5*b* which are movably attached to each other so, that plates 5*a*, 5*b* can be moved relative to each other along the direction of passage opening 4. The door unit motion is provided by a hydraulic cylinder mechanism, a work cylinder 6 of which is attached by attachment members 7 to the sliding door module. Work cylinder 6 is totally or mainly inside the module. The operation of a power shaft 8 of the work cylinder is carried out in direction L. The motion of the door unit is guided along a guide lath 9*a* and by wheels 10 along a guide rail 9 supporting the door unit. Wheel 10 is journalled at a bearing 11. In order to secure a closed position of the door unit, lath 9*a* is provided with rather shallow depressions 31 for the reception of wheels 10. The edges of depression 31 are slightly inclined in direction L. A front edge 12 of the door unit is stopped at a stop surface 13 of the frame at the latest during a closure of opening 4. The back-recoil of the door unit from stop surface 13 is prevented during the closure of passage opening 4. This is arranged by having guide lath 9*a* inclined downwards in the door closing direction or by forming depression 31 located nearest to stop surface 13 to downward chamfered. Near its halt position, the door moves mainly by means of its own kinetic energy, although the thrust action of bar 8 is stopped somewhat earlier during the closure of the passage opening. Passage opening 4 is surrounded by a sealing member of the frame, for instance by a metal lath or a permanent portion of the frame element acting as a back surface, such as a surface protrusion 14 going around opening 4 inside the module. The door unit function governing levers and switches 16 are attached at frame element 3*a* and 3*b* outside the sliding door module. Levers and switches 16 can also be attached in the vicinity of opening 4 at that flange 15*a* of door module flanges 15 which is nearest to stop surface 13 of the frame. Within the same location area is also a manually operated pump for an emergency function of the door. The location of a pressure reservoir and an electrically operated pump of the hydraulic mechanism are not shown, as they obviously can be located by several different ways. Reference numeral 16*a* refers to an actuator device of a limit switch, which is operated by a fro-and-back movable pin 32, which can be spring-assisted. Numeral 34 refers to a gasket.

Figure 2:
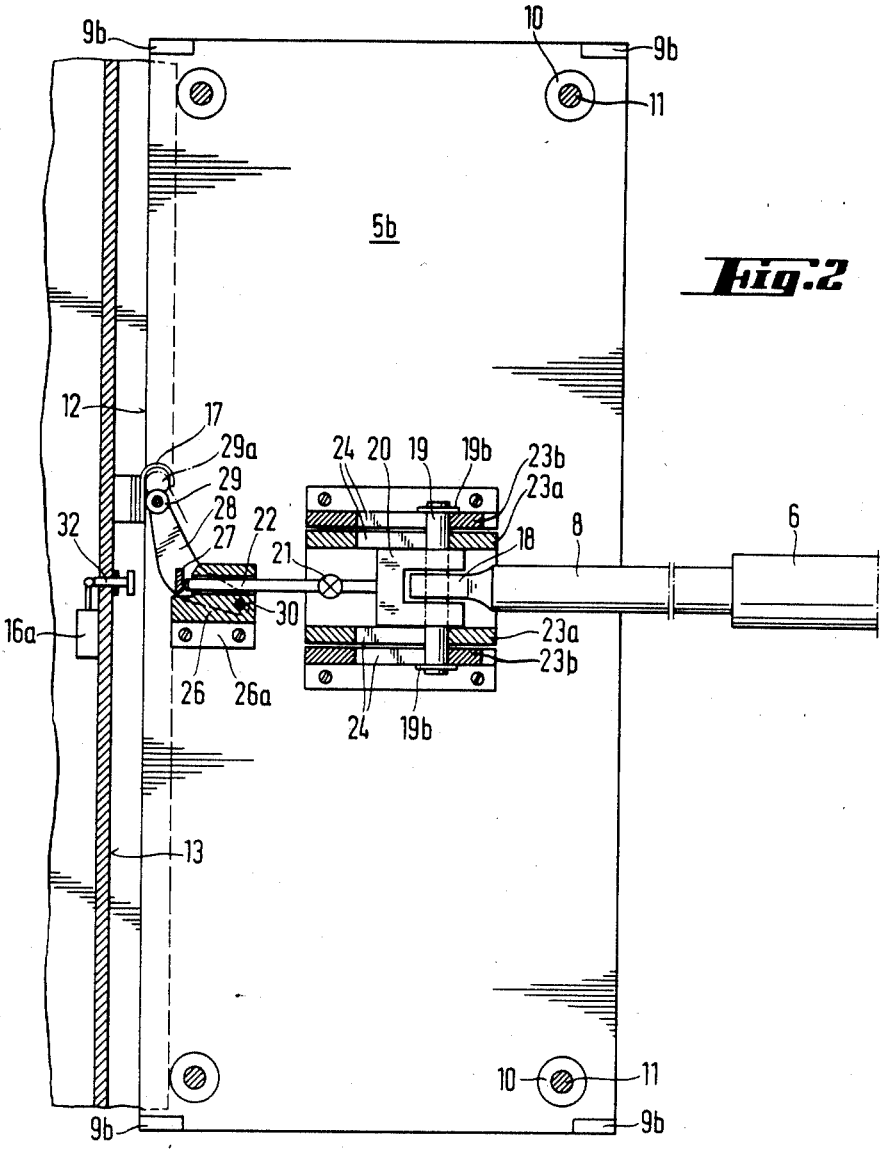
FIG. 2 shows a detail of FIG. 1.

FIG. 2 discloses a door unit, from which door plate 5*a* is removed for clarity reasons. Reference numeral 17 refers generally to a device guiding the door function. For holding a power transmission bolt 19, a grip 18 is attached to power shaft 8 of work cylinder 6. Instead of grip 18 one can apply a ball joint attached to the end of shaft 8. Bolt 19 transmits power via grip member 20 and joint 21 to limit arm 22. Flanges 23*a* are attached to door plate 5*a* and flanges 23*b* to door plate 5*b*, which flanges define an opening, a slot, a groove 24 or the like for guiding the motion of bolt 19. Reference numeral 19*b* refers to a common base washer. Between limit arm 22 and grip member 18 is located a ball joint 21. The motion of limit arm 22 is guided by a guide 26. At door plate 5*b* is attached a device 27–29, by which the motion of limit arm 22 is adjusted relative to door plate 5*b*. The device comprises a guard arm 28, attached to door plate 5*b* or to guide 26 by a journalled peg 30, and a guide roller 29 journalled at arm 28. A guard 27 is attached at the arm, which guard prevents limit arm 22 from moving relative to door plate 5*b*. Arm 22 therefore pushes guard 27 in the direction for closing opening 4. Arm 22 can move relative to door plate 5*b* only when guard 27 is in the unobstructed position. The door unit motion stops after a head or roller 29 of the guard arm 28 hits the door frame or a guide device 17 thereof and, as a result hereof, guard 27 moves out of the way of limit arm 22. Reference numeral 29*a* refers to an altered postion of guide roller 29. The functions of guide roller 29, limit arm 22 and guide device 17 during the opening and closing motion of the door are described later on.

Figure 3:
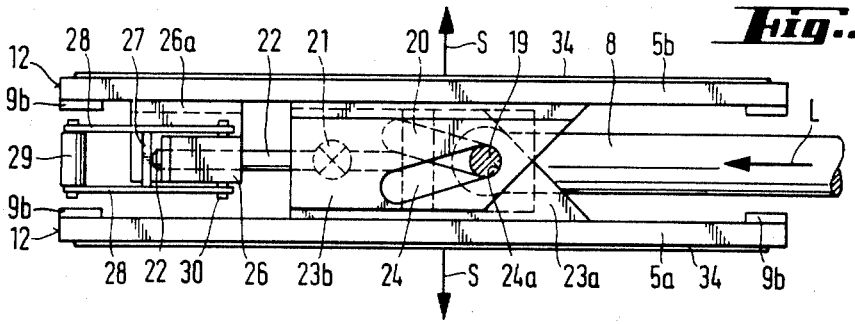
FIG. 3 shows a detail of a moving door unit in a top view.

Limit arm 22 is in FIG. 3 locked via guard 27 to door plate 5*b*, whereby bolt 19 is at the same time at a bottom 24*a* of grooves 24, so that the separation between door plates 5*a* and 5*b* is the smallest possible. Bolt 19 is shown sectioned, so that a circular washer is not shown. The motion of the door unit corresponding the closure and opening function is shown by an arrow L. An arrow S refers to a separation and an approach shift of door plates 5*a* and 5*b*, which is carried out by power transmission bolt 19. The earlier described rail 9 operates as a guide in the direction S, also.

Figure 5:
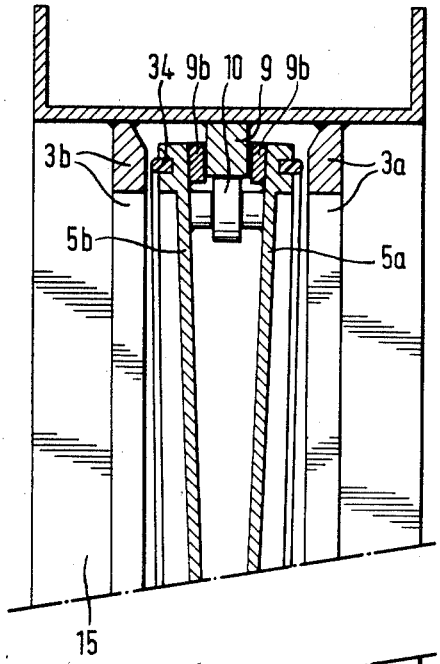
FIG. 5 shows a detail of FIG. 4, FIGS. 6 and 6*a* show a magnified detail of FIG. 4, FIGS. 7 and 8 show two stages during the closure phase of the door, viewed as in FIG. 1.
Figure 5:
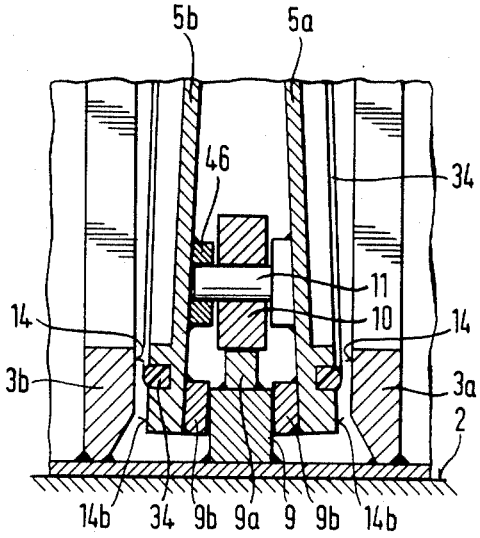
Figure 4:
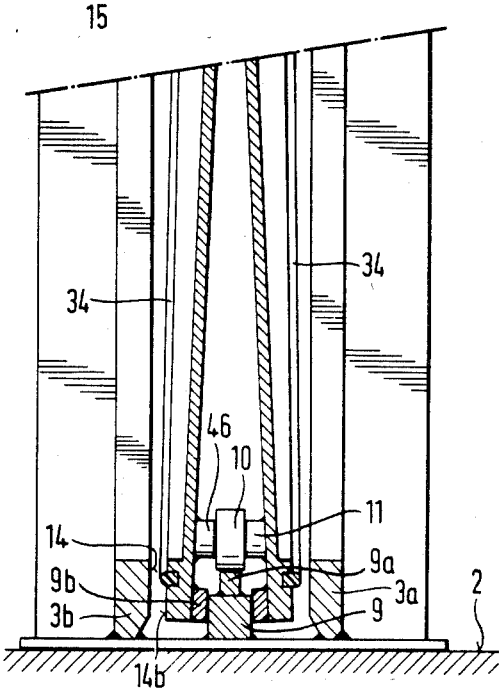
FIG. 4 shows the sliding door partly sectioned, viewed parallel to the wall construction plane.

Frame elements 3*a* and 3*b* are attached to each other to form a water tight casing, inside which the door unit moves. Casing head 3*c* comprises an opening, through which the door unit is mounted in the casing. The opening is closed by head plate 3*d*, at which the hydraulic cylinder is attached, for instance by a bolt 3*f* attachment. Each frame element comprises as a sealing surface a back surface 14, which surrounds door opening 4 as seen in FIG. 4. Wheel 10 is journalled at shaft 11, which is attached to door plate 5a and slidably supported at a bushing 46. Bushing 46 is attached to door plate 5b and allows an axially directed motion of shaft 11. The principal construction of door plates 5a, 5b is partly shown in FIGS. 4 and 5. The figures represent a situation, during the closure of passage opening 4, just before a S-shift. The door plate is prestressed so that in the vertical direction door plates 5a and 5b are nearest to each other within their central portion, when the door is in the open condition. The door plate is provided with stiffeners so that the leaf is flexible in the direction of the deflection obvious in FIG. 4. One stiffener construction is such that a stiffener bar is mounted in L-direction at the door plate surface. The deflected door plate can at best be described to resemble a portion of a cylinder surface. The door stiffeners are arranged in L-direction so that the door plate is rigid against a deflection whereby one tries to bend the vertical edges of the door plates towards each other or away from each other. Reference numeral 9b refers to an adjustment lath between rail 9 and door plates 5a, 5b. The small clearance between lath 9b and rail 9 is not shown in detail.

Figure 6:
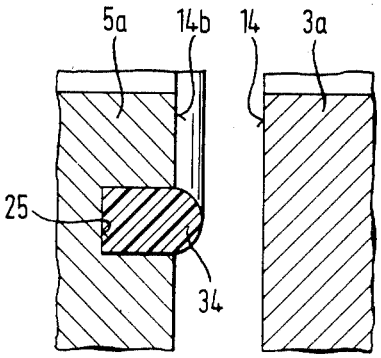

A sealing arrangement between door plate 5a and frame element 3a is shown more in detail in FIG. 6. A gasket 34 is attached to door plate 5a, for instance a rubber-like, a plastic-like or a metal gasket band. The band can be mounted in a groove 25 so that the gasket is settled deeper in the groove as the compression increases. Hereby will the door plate and frame surface 14 directly contact each other. A suitably chosen gasket can also be formed along the direction of door plate surface so, that this gasket layer is compressed between door surface and a back surface 14b. The application of a gasket material of this type is possible because the contact between gasket 34 and back surface 14 takes place after the halt of closure motion L.

Figure 6A:
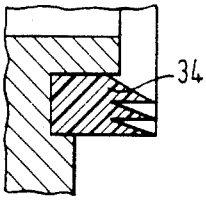

Consequently, there is no sliding, rubbing or scraping motion against gasket 34, causing wearing of gasket 34. FIG. 6a shows another gasket form, which is easy to mount. This gasket is an effective seal against eventual raising water pressure, which directs from the module outwards.

Figure 7:
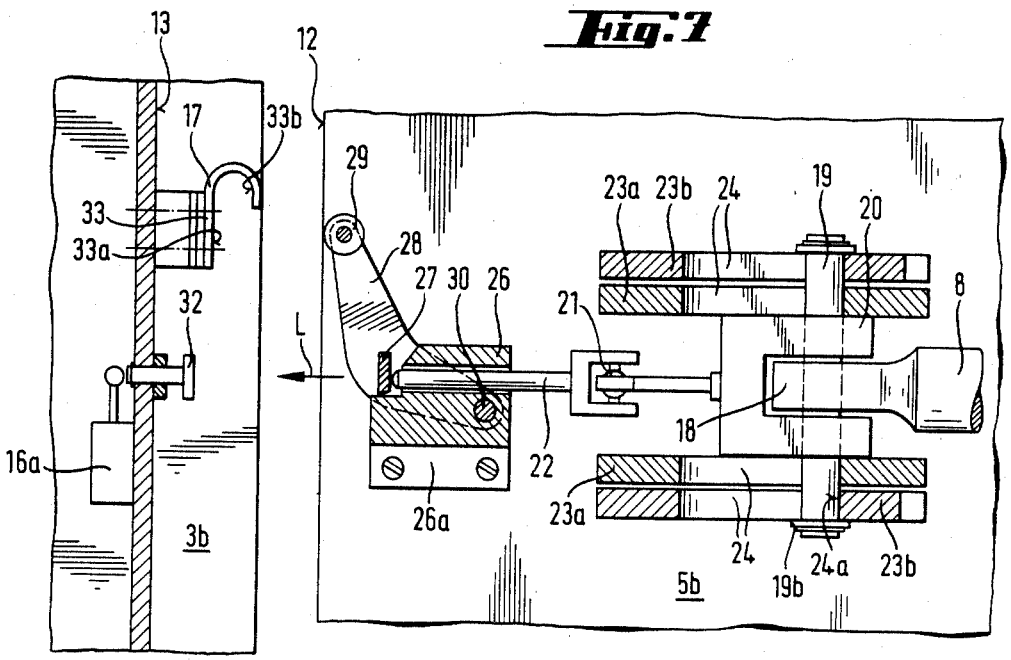
Figure 8:
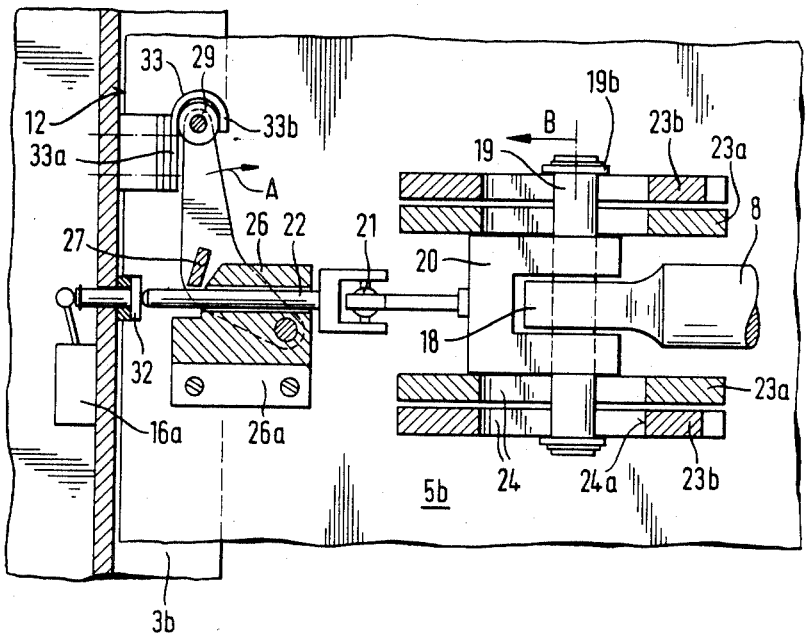

An arrangement is shown in FIGS. 7–8 for the realization of shift S of door plates 5a and 5b along the direction of passage opening 4. During the final phase of closure motion L of the door unit, guide roller 29 touches a guide surface 33a of guide device in a guide body 33, which is attached to back surface 13 of the frame element. Guide surface 33a is so arranged that guide roller 29 moves vertically upwards in a grip member formed by surface 33a and a protrusion 33b. The motion of roller 29 relative to door plate 5b is arranged to rotate guard arm 28 around its attachment bearing 30 in the direction A. Guard 27 is moved out of the way of arm 22 by means of motion A. Hereby the front edge 12 of the door and a stop member 13 of the frame element contact each other. Bolt 19 begins to move in groove 24 (arrow B). Simultaneously with a B-directed motion of bolt 19, bolt 19 acts upon guide grooves 24 in guide plates 23a and 23b so, that door plates 5a and 5b move outwards in direction S. The form of guide grooves 24, the function of guard device 27–29 and guide surface 33a as well as motion B are guided by limit switch 32 and cylinder 6 and are so arranged, that motion B is halted first after a tight contact of gasket 34 and back surface 14. The thrust of hydraulic cylinder 6 acts via power shaft 8 so that power bolt 19 and arm 22 are moved in direction B. Motion B is halted when arm 22 engages limit switch 32 and 16a so that the motion of bolt 19 and arm 22 is stopped.

During the opening of passage opening 4, gasket 34 is first separated from the contact to back surface 14. This is carried out by means of cylinder 6, moving power shaft 8, bolt 19 and arm 22 in the opposite direction relative to direction B. During this phase of the operation, door plates 5a and 5b are not moved in direction L because preventing protrusion 33b of the grip member prevents the motion in direction L of guide roller 29, which is connected to door plate 5b via guard arm bearing, from moving in direction L. Hereby is wheel 10 located in depression 31, which boosts up the stationary holding of the door unit. During the final phase of the motion of bolt 19 in groove 24, arm 22 is at the same time moved to such a position that guard 27 can move to its initial position (FIG. 2). The power of shaft 8 is now transmitted to door leafs 5a and 5b. Hereby is the actual opening motion L of the door unit started.

Two modifications of the sliding door arrangement are shown in FIGS. 9–10, of which the construction shown in FIG. 9 comprises a separate guide lath 14a arranged around passage opening 4. In order to facilitate passage through opening 4, turnable threshold ramps 35 (FIG. 10) can be arranged in connection with passage opening 4. Threshold ramps 35 and guide lath 9a form an unobstructed bridge arrangement in an open passage opening 4. In order to arrange a safe closure function, turning devices 36 are arranged at the lower portion of front edge 12 in door leafs 5a, 5b. The plough-like turning device 36 turns threshold ramp 35 around a hinge 37, when one closes the door unit. Hereby is ramp 35 turned until it is out of the way of door leaf 5a, 5b. A position 38 of ramp 35 corresponding to the closed situation of the door unit is shown in FIG. 10 by broken lines. Starting from the shown position 38, ramp 35 will form a bridge by means of its own torque, when one opens the door unit.

The water tightness of the sliding door according to the invention is equally good in both passage directions of the passage opening 4. In the closed position of the door, the gasket in each door leaf 5a, 5b is tightly against surface 14 all over the path surrounding opening 4. As an example of the door function a situation is discussed, in which as a result of a fracture in the ship's hull or due to some other reason water is rising outside the module at one side thereof. The water pressure against leaf 5a tends to open the joint between back surface 14 of frame 3a and gasket 34. Hereby will water enter in the module. However, a flexible attachment is comprised between door leafs 5a, 5b by means of shaft 11 and bushing 46. As a result of this, the raising water inside the door module will thrust door leaf 5b against frame 3b, whereby gasket 34 is pressed more tightly against back surface 14. A similar function is possible by a water pressure initially starting from the side of door leaf 5b.

PREFERRED MODIFICATIONS OF THE INVENTION

Figure 11:
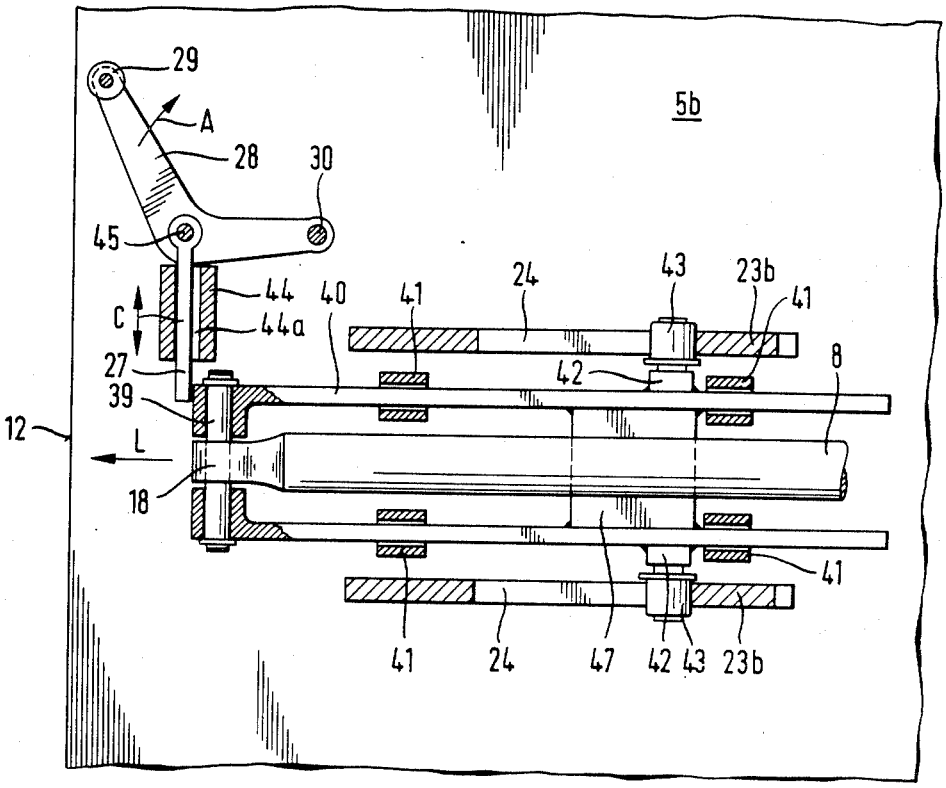
FIG. 11 shows a modification associated with the door unit.

In FIG. 11 is shown a modified construction of the door unit for guiding the functions in the L- and S-directions. Power shaft 8 extends along the direction of door leaves 5a and 5b so that grip 18 is in the vicinity of front edge 12 of the door. The power is transmitted from shaft 8 via grip 18 and transfer bolt 39 to a slide 40. Slide 40 is movable in L-direction, if guard 27 is in a position which releases shaft 8 from door leaf 5*b*. Slide 40 slides through guides 41, which are attached at door leaf 5*a*. Slot 24 in support plate 23*b* is mainly similar to that in FIG. 3. A corresponding other modification (FIG. 7) is possible by arranging groove 24 in flange 23*b* parallel to door leaf 5*b* and those grooves 24 in flanges 23*a* inclined relative to leaf 5*a* like in FIG. 3. Slide 40 includes an arm 42, at which a guide roller 43 is journalled, which roller is moved in groove 24 of flange 23*b* as shown by FIG. 11. Guard 27 is journalled at guard arm 28 by a bearing 45 and guided by a guide 44 attached to door leaf 5*b*. The dimensions of guard 27, the rotation A of guard arm 28, the function of bearing 45 and a space 44*a* of guide 44 which receives guard 27 are mutually so adjusted, that guard 27 is movable in vertical direction C.

Figure 11A:
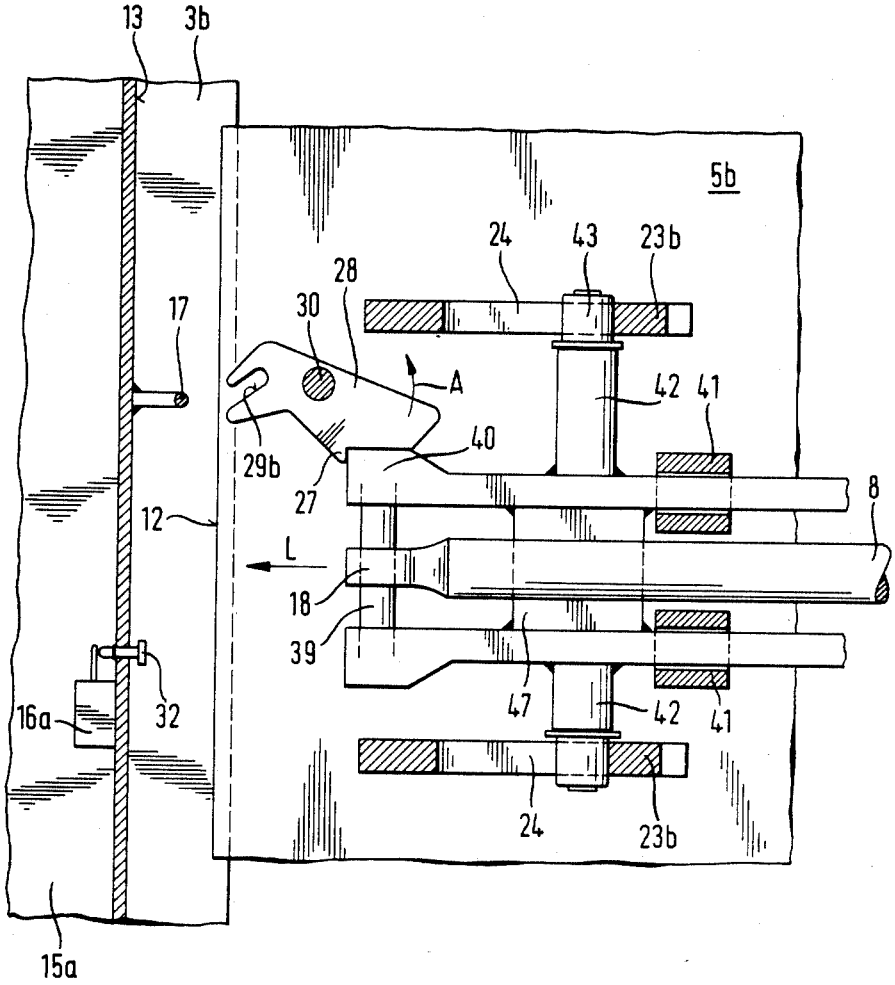
FIG. 11*a* shows another modification associated with the door unit.

FIG. 11*a* shows a modification of the slide arrangment shown in FIG. 11. Two slide arms 40 are mutually connected by a connector plate 47. Door frame comprises a ring-like actuator-locking member 17 which is applied in association with a guide slot 29*b* in retainer arm 28. Retainer arm 28 comprises a retainer protrusion 27, the function of which is similar to the earlier described corresponding members. Arm 28 is turned in direction A after slot 29*b* engages ring 17. Hereby is slide 40 free to move in direction L. For the door opening, slide 40 moves in the opening L-direction (to right), until roller 43 engages the slot stop edge in support plate 23*a*. Hereby is the S-shift completed, as well. The total power of shaft 8 being directly acting on leafs 5*a* and 5*b*, arm 28 will release its grip from ring 17 and arm 28 is turned to the initial state shown in FIG. 11*a*. FIGS. 11 and 11*a* show such constructions, in which arm 40 moves mainly parallel to door leaf 5*a* whereby door leaf 5*b* is shifted in S-direction relative to leaf 5*a* and arm 40/shaft 8.

The invention is not limited to the embodiments shown but several modifications thereof are possible within the scope of the attached claims. Arm 42 (FIG. 11) and guide 41 can be adjusted to contact each other, when arm 12 is in its extreme location to right or left.

I claim:

1. A sliding door arrangement for closing a passage opening in a generally vertical wall construction, said door arrangement comprising:

a frame unit attachable to said wall construction and bounding a door opening which corresponds to the passage opening when the frame unit is attached to the wall construction, said frame unit including two frame members arranged in spaced relationship and having respective sealing surfaces which surround the door opening in mutually confronting relationship;

a door unit mounted in the space between the frame members and including two door plates, said door unit being movable relative to the frame unit between an open position in which the door unit leaves the door opening essentially clear and a closed position in which the door unit blocks the door opening and the two door plates are in tight contact with the two sealing surfaces respectively about substantially the entire periphery of the door opening; and means for guiding the door unit to move relative to the frame unit in sliding manner without contacting the sealing surfaces during at least the major part of the movement of the door unit between the open position and the closed position, and for bringing about movement of at least one of the door plates away from the other door plate when the door unit has substantially completed its sliding movement from the open position towards the closed position, and for bringing about movement of said one door plate towards said other door plate before the door unit undergoes substantial sliding movement from the closed position towards the open position.

2. An arrangement according to claim 1, wherein during movement of the door unit from the open position to the closed position, the movement of said one door plate away from the other door plate occurs after the door unit has completed its sliding movement, and during movement of the door unit from the closed position to the open position, the movement of said one door plate towards the other door plate occurs before the door unit commences its sliding movement.

3. An arrangement according to claim 1, wherein the door plates are mechanically interconnected by a member whereby said one door plate is movably supported.

4. An arrangement according to claim 1, wherein the guide means maintain the door plates in substantially fixed relative positions during at least the major part of the sliding movement of the door unit.

5. An arrangement according to claim 1, wherein the door unit comprises force transmission means for bringing about movement relative to the frame unit of each of the door plates away from the other.

6. An arrangement according to claim 5, comprising a closure device for bringing about movement of the door unit from its open position to its closed position, and wherein said force transmission means comprise support elements secured to the door plates respectively and each formed with a slot or groove that is inclined with respect to the direction of sliding movement of the door unit, and a force transfer bar movable in the slot or groove to bring about movement of the door plates away from each other, said force transfer bar being connected to the closure device.

7. An arrangement according to claim 5, wherein the door unit comprises guard means which, during sliding movement of the door unit from the open position towards the closed position, operate to prevent the force transfer bar from moving in the slot or groove.

8. An arrangement according to claim 5, comprising a closure device for bringing about movement of the door unit from its open position to its closed position, and wherein said force transmission means comprise a slide element, guides secured to said other door plate for guiding movement of said slide element parallel to the surface of said other door plate, means coupling said slide element to said force transmission means, a support element secured to said one door plate and defining a slot or groove that is inclined with respect to the surface of said one door plate, and a transfer element mounted on said slide element and movable in said slot or groove to bring about movement of said one door plate away from said other door plate.

9. An arrangement according to claim 5, wherein said force transmission means bring about greater movement of said other door plate relative to the frame unit than of said one door plate relative to the frame unit.

10. An arrangement according to claim 1, wherein the door unit comprises guard means which, during sliding movement of the door unit from the open position towards the closed position, operate to prevent movement of said one door plate away from the other door plate until the door unit has substantially completed its sliding movement, and closure means for bringing about movement of the door unit from the open position to the closed position.

11. An arrangement according to claim 10, wherein the door unit comprises transmission means operable to bring about movement of each of the door plates away from the other, said transmission means being operable only when the guard means are inoperative and being influenced also by the closure means.

12. An arrangement according to claim 11, wherein the guard means are mechanically rendered operative and inoperative.

13. An arrangement according to claim 1, constructed as a self-supporting module inside which the door unit is disposed.

14. An arrangement according to claim 13, wherein the module is supported in use on a generally horizontal support structure.

15. An arrangement according to claim 1, comprising a guide wheel support shaft attached to said one door plate and movably mounted to said other door plate, and wherein the guide means comprise a guide wheel journalled on said support shaft and a guide rail engaged by the guide wheel and along which the guide wheel runs during sliding movement of the door unit, whereby the support shaft is moved in a direction through said door opening when said one door plate is moved away from said other door plate.

16. An arrangement according to claim 15, wherein the guide rail is disposed at the bottom of the frame unit and the guide wheel is disposed at the bottom of the door unit, and the guide rail is provided with means for retaining the door unit in its closed position.

17. An arrangement according to claim 16, wherein the guide rail comprises a base member and a guide lath mounted thereon, and the retaining means comprise a depression in the guide lath for receiving the guide wheel when the door unit is in the closed position.

18. An arrangement according to claim 17, wherein the upper surface of at least a portion of the guide lath slopes downwardly in the direction of movement of the door unit from the open position towards the closed position when the base member is disposed substantially horizontal.

19. A ship comprising a door arrangement according to claim 1, the frame unit being mounted on a substantially horizontal support structure.

20. A ship according to claim 19, wherein said support structure is a deck of the ship and the frame unit is mounted in direct contact therewith.

* * * * *